US006810954B2

(12) United States Patent
Garrett et al.

(10) Patent No.: US 6,810,954 B2
(45) Date of Patent: Nov. 2, 2004

(54) PRODUCTION FLOW TREE CAP

(75) Inventors: Michael R. Garrett, Houston, TX (US); Scott K. Beall, Houston, TX (US); Rogelio Ortiz, Houston, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 10/356,463

(22) Filed: Jan. 31, 2003

(65) Prior Publication Data

US 2003/0111228 A1 Jun. 19, 2003

Related U.S. Application Data

(63) Continuation of application No. 09/805,090, filed on Mar. 13, 2001, now abandoned, which is a continuation-in-part of application No. 09/770,588, filed on Jan. 26, 2001, now abandoned.

(60) Provisional application No. 60/178,845, filed on Jan. 27, 2000.

(51) Int. Cl.[7] ..... E21B 34/02

(52) U.S. Cl. ..... 166/77.51; 166/368; 166/86.1

(58) Field of Search ..... 166/338, 344, 166/347, 368, 378, 380, 382, 77.51, 86.1

(56) References Cited

U.S. PATENT DOCUMENTS

| | | | | |
|---|---|---|---|---|
| 3,279,536 | A | 10/1966 | Wakefield, Jr. | 166/0.5 |
| 3,662,822 | A | 5/1972 | Wakefield, Jr. | 166/0.5 |
| 3,731,742 | A | 5/1973 | Sizer et al. | 166/315 |
| 3,912,008 | A | 10/1975 | Crowe | 166/212 |
| 4,077,472 | A | 3/1978 | Gano | 166/360 |
| 4,133,378 | A | 1/1979 | Gano | 166/85 |
| 4,139,058 | A | 2/1979 | Gano | 166/360 |
| 4,154,298 | A | 5/1979 | Gano | 166/85 |
| 4,886,121 | A | 12/1989 | Demny et al. | 166/382 |
| 5,372,199 | A | 12/1994 | Cegielski et al. | 166/368 |
| 5,544,707 | A | 8/1996 | Hopper et al. | 166/382 |
| 5,988,282 | A | 11/1999 | Cuiper et al. | 166/348 |
| 6,062,314 | A | 5/2000 | Nobileau | 166/368 |

FOREIGN PATENT DOCUMENTS

| | | |
|---|---|---|
| GB | 2166775 A | 5/1986 |
| GB | 2192921 A | 1/1988 |
| WO | WO 86/01852 | 5/1986 |

OTHER PUBLICATIONS

SPE 23050, *Electrical Submersible Pumps in Subsea Completions*, P.A. Scott, M. Bowring and B. Coleman, 1991.
*Electric Submersible Pump for Subsea Completed Wells*, Sigbjorn Sangesland, Nordic Counsel of Ministers Program for Petroleum Technology, Nov. 26–27, 1991.
*A Simplified Subsea System Design*, Sigbjorn Sangesland, Underwater Technology Conference, Bergen 1990.
*Simplified Subsea System Design*, Sigbjorn Sangesland, Subsea Production Technology, CE–Course, Oct. 23–27 and Nov. 20–24, 1989.

(List continued on next page.)

*Primary Examiner*—Frank Tsay
(74) *Attorney, Agent, or Firm*—Howrey Simon Arnold & White LLP

(57) ABSTRACT

A christmas tree to control the production from a subsea oil or gas well is disclosed. The christmas tree design including a tree body having a first flow port and a tree cap; a tubing hanger landed within the tree body; an actuation mandrel landed within the tree body, the actuation mandrel having a flow port; and a flow diverter disposed within the tree cap to divert flow through the flow port. The christmas tree arrangement allows for dual barriers within the tree cap without placing or retrieving any plugs from within the tubing hanger, thereby reducing the number of downhole trips required to complete and/or service the subsea well.

31 Claims, 22 Drawing Sheets

OTHER PUBLICATIONS

*A Simplified Subsea System Design*, Sigbjorn Sangesland, Presented at Underwater Technology Conference in Bergen, Mar. 19–21, 1990.

*Declaration of David Lorimer* (*and attchments dated 1991*), David Lorimer, Submitted in Civil Action No. H–97–0155 (Cooper Cameron Corp. v. Kvaerner Oilfield Prods, Inc.), Jul. 10, 2002.

*Subsea Submersible Pumping Project Task Series 1000 Equipment Evaluations*, Vetco Gray.

*First Interim Report—Technical*, Subsea Intervention Systems, Ltd., Project No. TH/03328/89, Jun. 1991.

*Subsea Submersible Pumping Project Task No. 2000 Conceptual Design Report*, Jan., 1991.

*Second Interim Report—Technical*, Subsea Intervention Systems, Ltd., Project No. TH/03328/89, Jun. 1991.

*Third Interim Report—Technical*, Subsea Intervention Systems, Ltd., Project No. TH/03328/89, Dec. 1991.

*Subsea Submersible Pumping Project, Final Report vol. 1*, Subsea Intervention Systems, Ltd., Task Nos. 3000 and 4000, Mar. 1992.

*Subsea Submersible Pumping Project, Final Report vol. 2*, Subsea Intervention Systems, Ltd., task Nos. 3000 and 4000, Mar. 1992.

*Subsea Submersible Pumping Project, Final Report vol. 3*, Subsea Intervention Systems, Ltd., Task Nos. 3000 and 4000, Mar. 1992.

*Through Bore Tree System*, Ref: TSD 6302, National Oilwell (UK) Limited, Jan. 1993.

*Declaration of Sigbjorn Sangesland and Attachments*, Sigbjorn Sangesland, Submitted in Civil Action No. H–97–0155 (Cooper Cameron Corp. v. Kvaerner Oilfield Prods, Inc.), Undated.

PRODUCTION FLOW TREE CAP

This is a continuation-in-part of U.S. patent application Ser. No. 09/770,588, filed Jan. 26, 2001, now abandoned, which is a continuation of application Ser. No. 09/805,090, filed Mar. 13, 2001, now abandoned, and claims the benefit of Provisional Application No. 60/178,845 filed Jan. 27, 2000.

FIELD OF THE INVENTION

This invention relates generally to subsea oil and gas production methods and apparatus and, more particularly, to a split tree cap christmas tree.

BACKGROUND OF THE INVENTION

The proliferation of rules and regulations for producing and transporting oil, gas, and other products over the years has led to many advances in well equipment and methodology. One object of particular concern in drilling, completion, and workover operations of a subsea well is that at all times there be at least two barriers between the production fluids and the local environment. The standard use of a double barrier prevents contamination in the event of a failure of the first barrier, whether that barrier is a seal, a valve, or some other apparatus.

In a typical well completion with a horizontal tree, it is conventional practice to complete the subsea well with a tubing hanger having a production tubing string suspended therefrom. The tubing hanger and the associated production tubing are run into a subsea horizontal tree on a running assembly usually comprising a tubing hanger running tool and a riser until the tubing hanger is landed and sealed in the horizontal tree. Typically the production tubing includes a downhole safety valve to shut-in production, if necessary. The wellhead carries a blowout preventer (BOP) stack which is connected to a marine riser through which the tubing hanger is run. Often the horizontal tree contains a plug or tree cap that provides a first barrier to production fluids above the tubing hanger and the production tubing in the horizontal christmas tree. A second barrier to the environment is typically provided by a second plug located within the production tubing hanger when the tubing hanger is run or retrieved.

As the well nears completion, or (in a completed well) when a workover or other well service operation is necessary, it is conventional practice to install or retrieve the plug in the tubing hanger to ensure a dual barrier to the ambient environment at all times. The installation of a plug in the tubing hanger becomes necessary, for example, when an operator needs to remove the BOP. However, the setting and/or retrieving of the plug in the tubing hanger requires a separate trip—usually by wireline. Because well drilling and completion operations are very expensive and often based on per hour rig charges, it is desirable to complete and/or service wells with as few downhole trips as possible to reduce rig time. It would be desirable and cost efficient to find a system that would allow well completion and servicing options without setting and retrieving the tubing hanger plug.

SUMMARY OF THE INVENTION

There is disclosed a christmas tree to control the production from a subsea oil or gas well. In one embodiment the system includes a tree body having a first flow port and a tree cap; a tubing hanger landed within the tree body; an actuation mandrel landed within the tree body, the actuation mandrel having a flow port; and a flow diverter disposed within the tree cap to divert flow through the flow port. The system may further include a backup flow diverter disposed within the tree cap, the flow diverters including plugs. In some embodiments the plugs are set by wireline.

In one embodiment of the christmas tree the first flow port is a production flow port. This first flow port may be a radial bore extending through the tree body.

In one embodiment the christmas tree includes a second flow port. This second flow port may be an annulus flow port. The annulus flow port may include a first partial bore, a second partial bore, and a channel extending therebetween. The channel may extend substantially longitudinally along the tree body. In one embodiment the first and second partial bores are arranged opposite one another.

In one embodiment the christmas tree further includes an integral production valve. In another embodiment the christmas tree includes a first countersunk area receptive of a production valve assembly.

In one embodiment the christmas tree further includes a second countersunk area receptive of an annulus flow assembly. The annulus flow assembly may attach to external fluid circulation lines. The external fluid circulation lines may include choke or kill lines.

In one embodiment the christmas tree further includes a third flow port. The third flow port provides fluid communication to a downhole safety valve. The third flow port may be receptive of a hydraulic penetrator to establish fluid communication to the downhole safety valve.

In one embodiment the christmas tree further includes a fourth flow port. The fourth flow port may provide for chemical injection into the well.

There is also disclosed a method of controlling production from a subsea oil or gas well, the method including the steps of: installing a side valve tree onto a wellhead, the side valve tree including a tree cap; running a tubing hanger into the wellbore; landing the tubing hanger in the tree body; installing an actuation mandrel with a plurality of plugs set therein; wherein the plurality of plugs are disposed within the tree cap and there are no plugs set in the tubing hanger.

The step of installing a side valve tree onto a wellhead may further include providing a tree bore protector.

According to the disclosed method the tubing hanger may include a production tubing suspended therefrom. The tubing hanger may include an orientation key mating with an orientation sleeve. Therefore, the method may further include the step of orienting the tubing hanger within the tree body.

In one embodiment the method may include the step of locking the tubing hanger within the tree body.

In one embodiment the step of installing an actuation mandrel with a plurality of plugs set therein includes orienting the actuation mandrel. The actuation mandrel may include a plurality of reduced-diameter shoulders and pack-off seals.

In one embodiment the step of installing an actuation mandrel with a plurality of plugs set therein further comprises landing the shoulders and seals within the tree body.

There is also disclosed a method of servicing a subsea oil or gas well with a side-valve christmas tree including the steps of: running an actuation mandrel retrieval tool into the christmas tree; engaging the actuation mandrel retrieval tool with the actuation mandrel; retrieving the actuation mandrel; and retrieving a tubing hanger; wherein there is no step of retrieving any plugs from within the tubing hanger.

BRIEF DESCRIPTION OF THE DRAWINGS

The foregoing and other features and aspects of the invention will become further apparent upon reading the following detailed description and upon reference to the drawings in which.

Figure 1A:
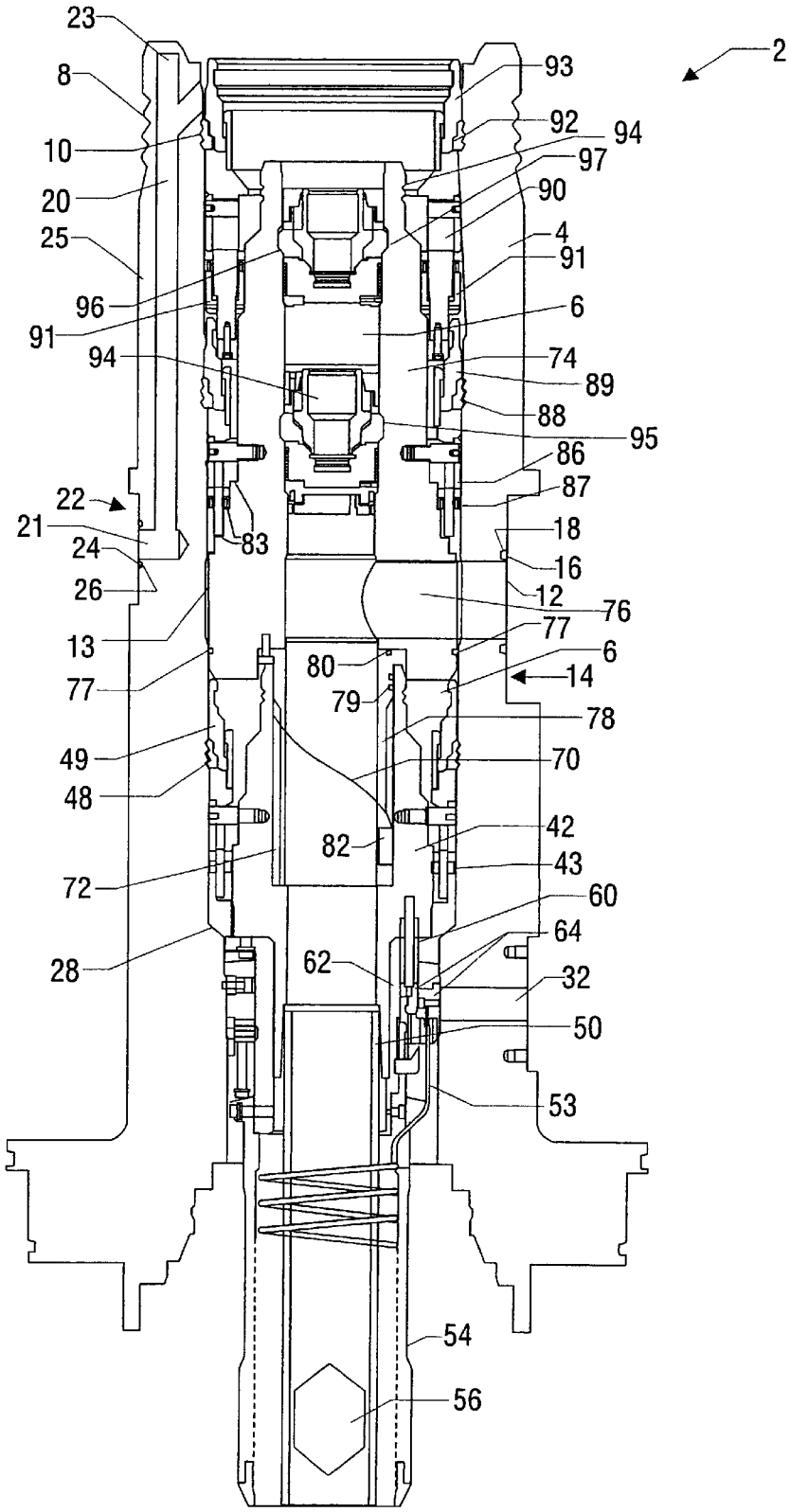
FIG. 1A depicts a split tree cap christmas tree design in accordance with one aspect of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the Figures, and in particular FIGS. 1A–D and 2, a split tree cap christmas tree design in accordance with one embodiment of the invention is disclosed christmas tree system 2 includes a generally cylindrical side valve tree body 4. Side valve tree body 4 defines an internal through-bore 6 extending longitudinally therethrough. The upper end of side valve tree body 4 contains a radial profile 8 adapted to engage an external connector. Profile 8 is intended to allow the connection of the christmas tree body 4 to other subsea equipment such as running tools, blowout preventers, and intervention packages by way of example. Other means of connection known in the art are easily applicable to connect the side valve tree body 4 to other equipment as needed.

Also located at the upper end of side valve tree body 4 is a radial internal running profile 10. Profile 10 provides a means to connect the side valve tree body 4 to a tree running tool. In addition, profile 10 is adapted to receive a lock down ring 92, retained by an associated lock down sleeve 93, as discussed below.

The lower end of side valve tree body 4 is adapted for installation on a wellhead 100. Tree body 4 may be adapted for installation on any standard size wellhead typically known in the art, for example an 18¾ inch wellhead. A connector secures the side valve tree body 4 to the wellhead 100 and resists the separation forces resulting from the pressure developed in a live well. A seal 102 disposed between the wellhead 100 and the side valve tree body 4, typically a gasket seal such as an AX gasket, prevents the passage of hydrocarbons to the environment at this connection.

Figure 1B:
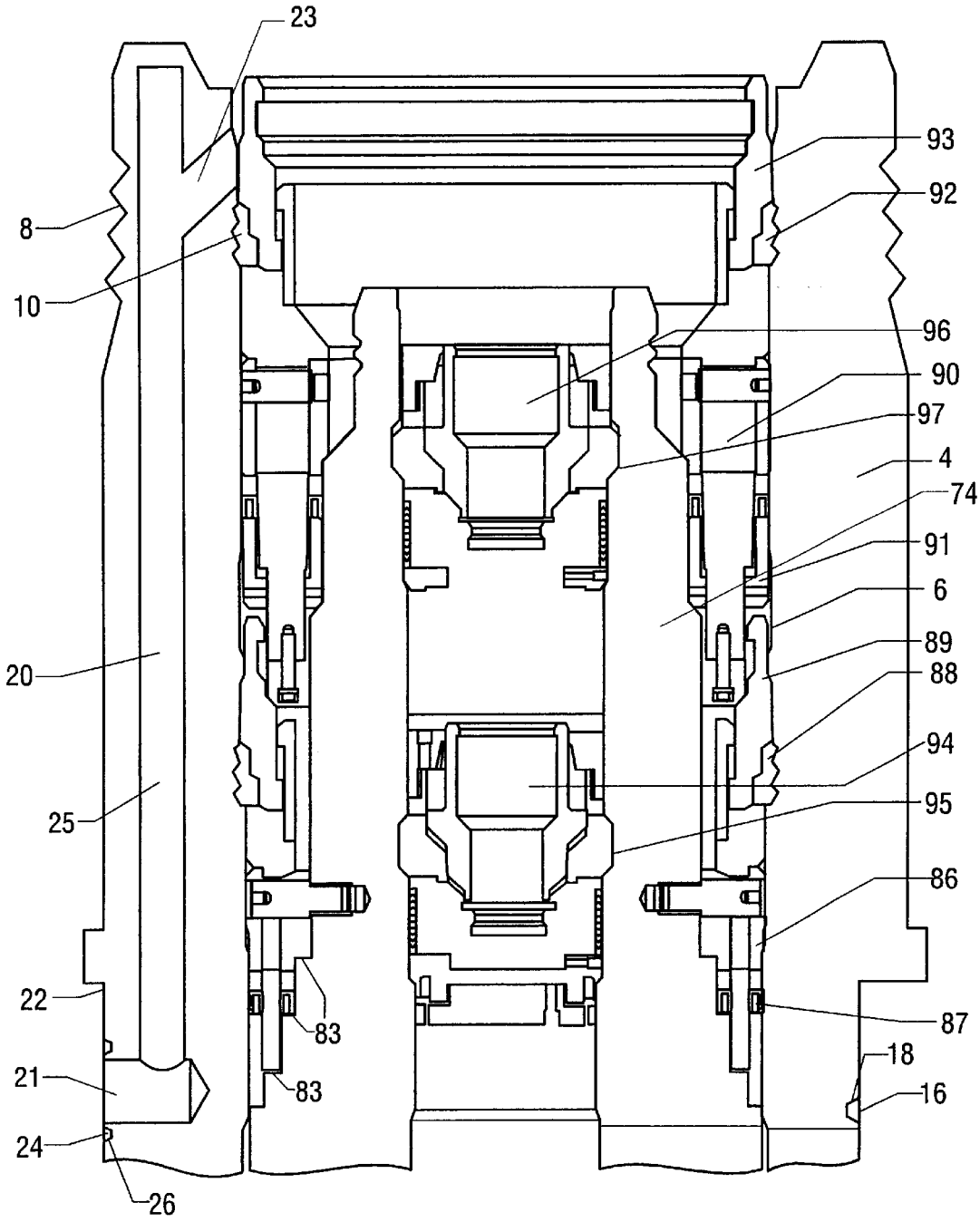
FIG. 1B depicts a detail of the split tree cap christmas tree design of FIG. 1A.
Figure 1C:
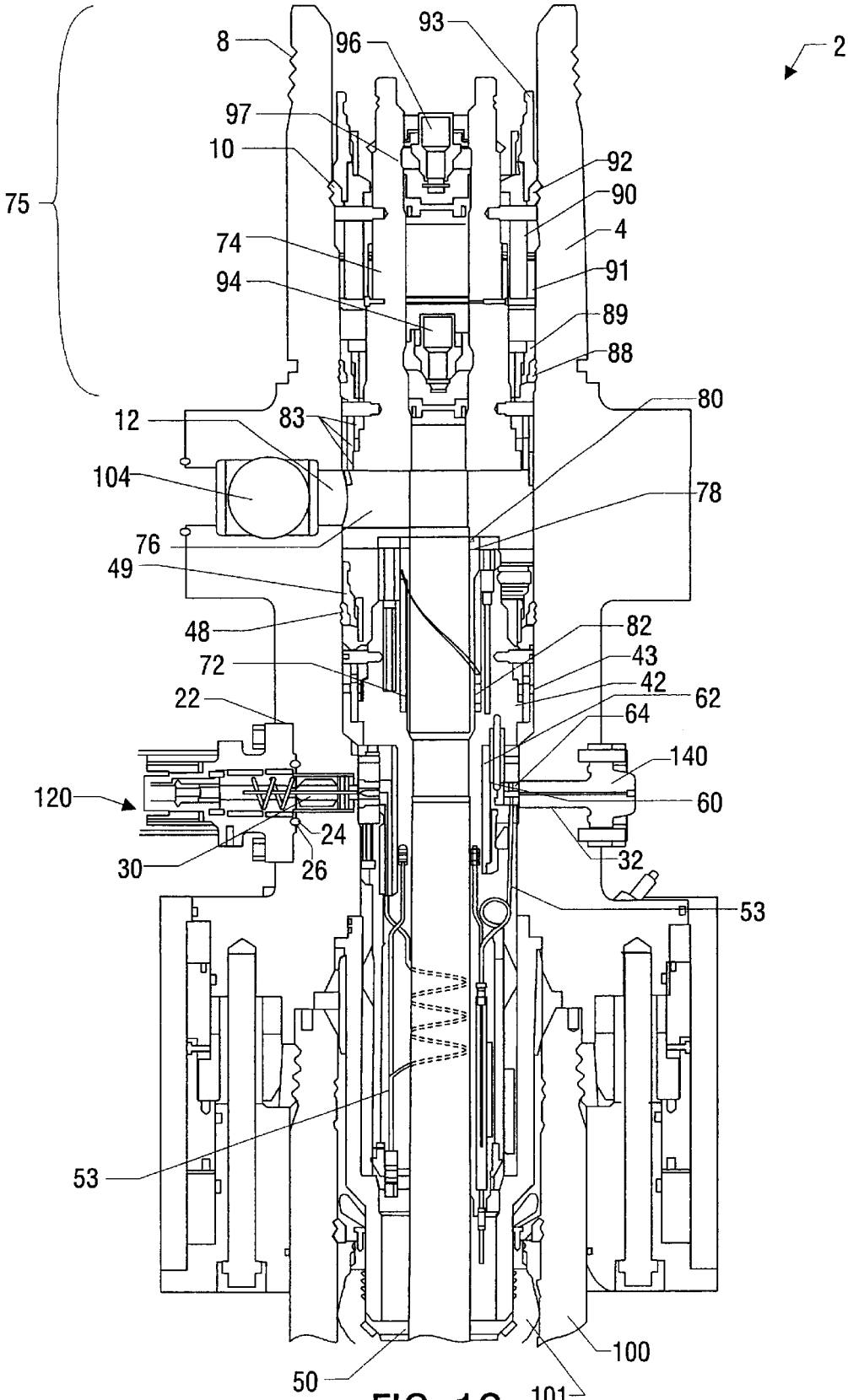
FIG. 1C depicts a split tree cap christmas tree design in accordance with another aspect of the invention.
Figure 1D:
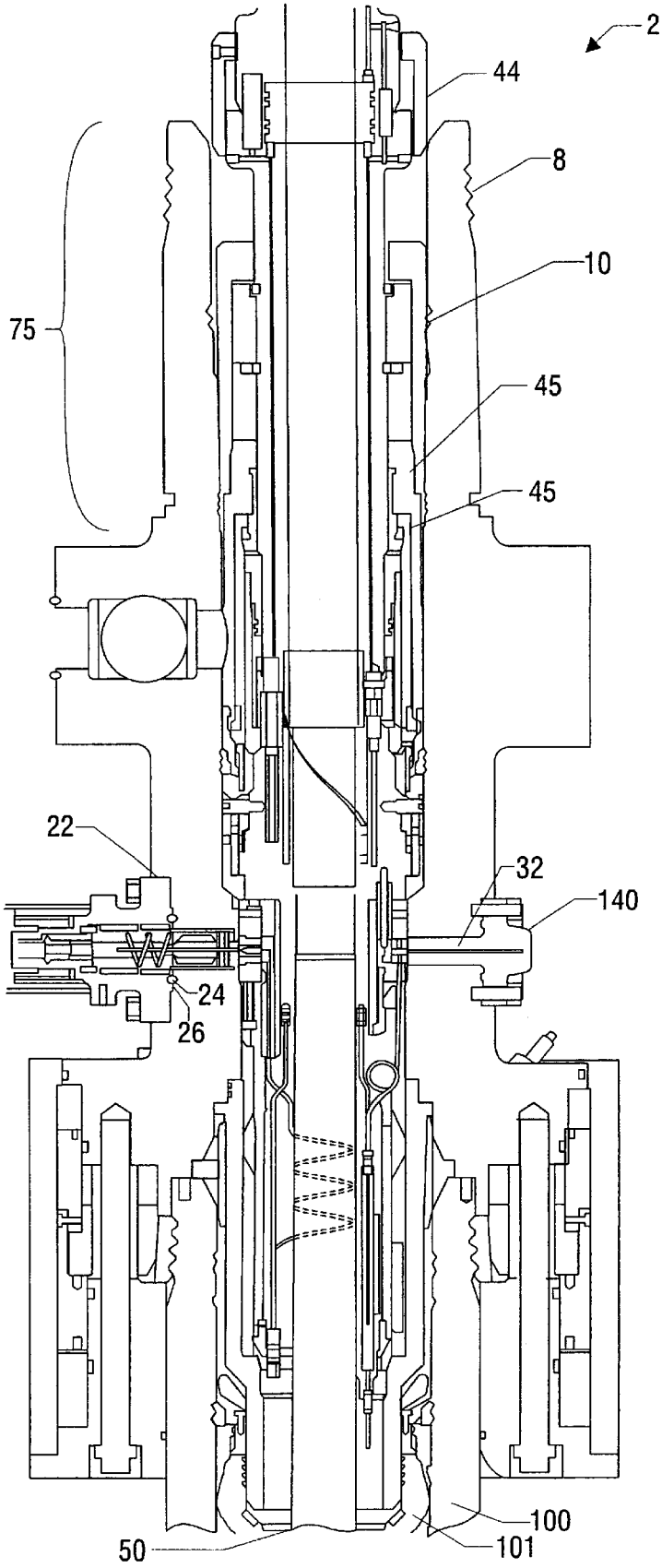
FIG. 1D depicts a split tree cap christmas tree design according to FIG. 1C in the run-in position.
Figure 2:
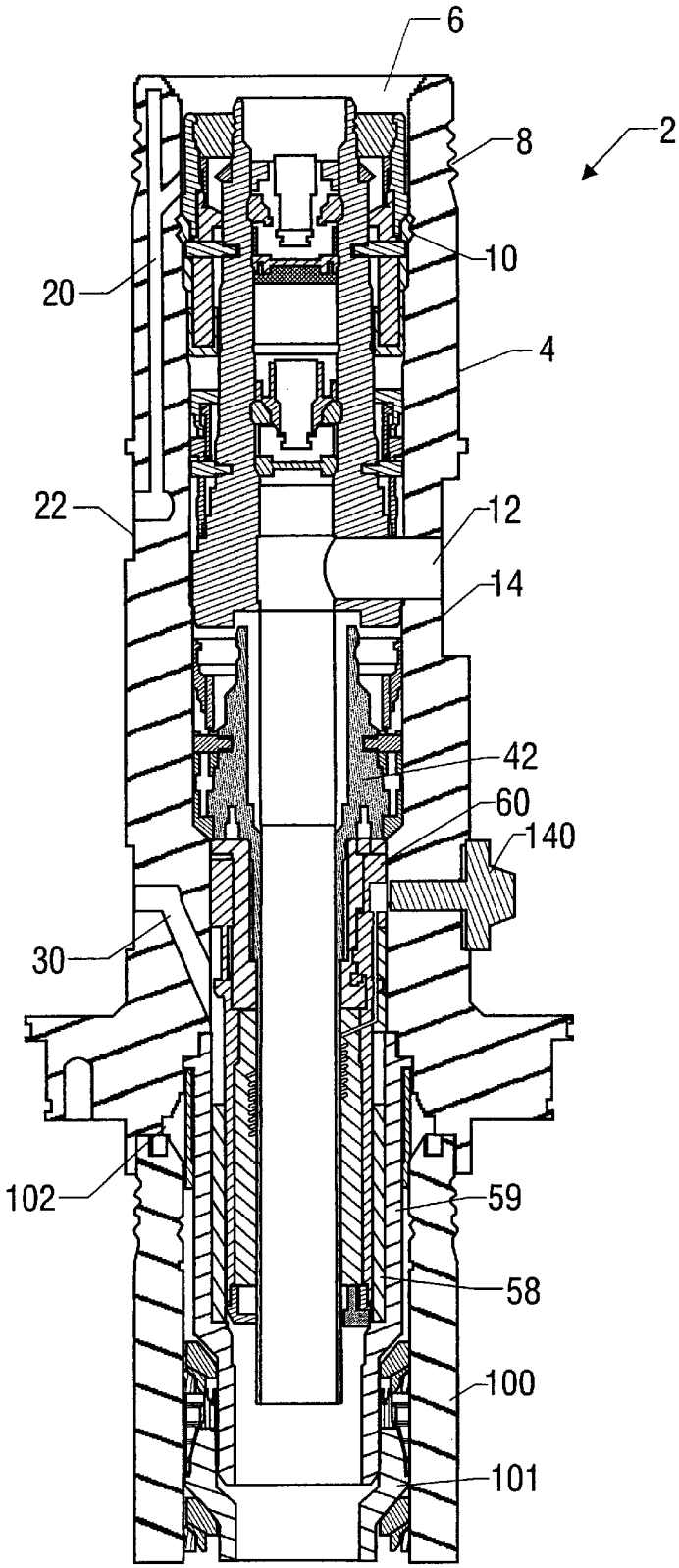
FIG. 2 depicts a split tree cap christmas tree in diagramatic form.
Figure 3:
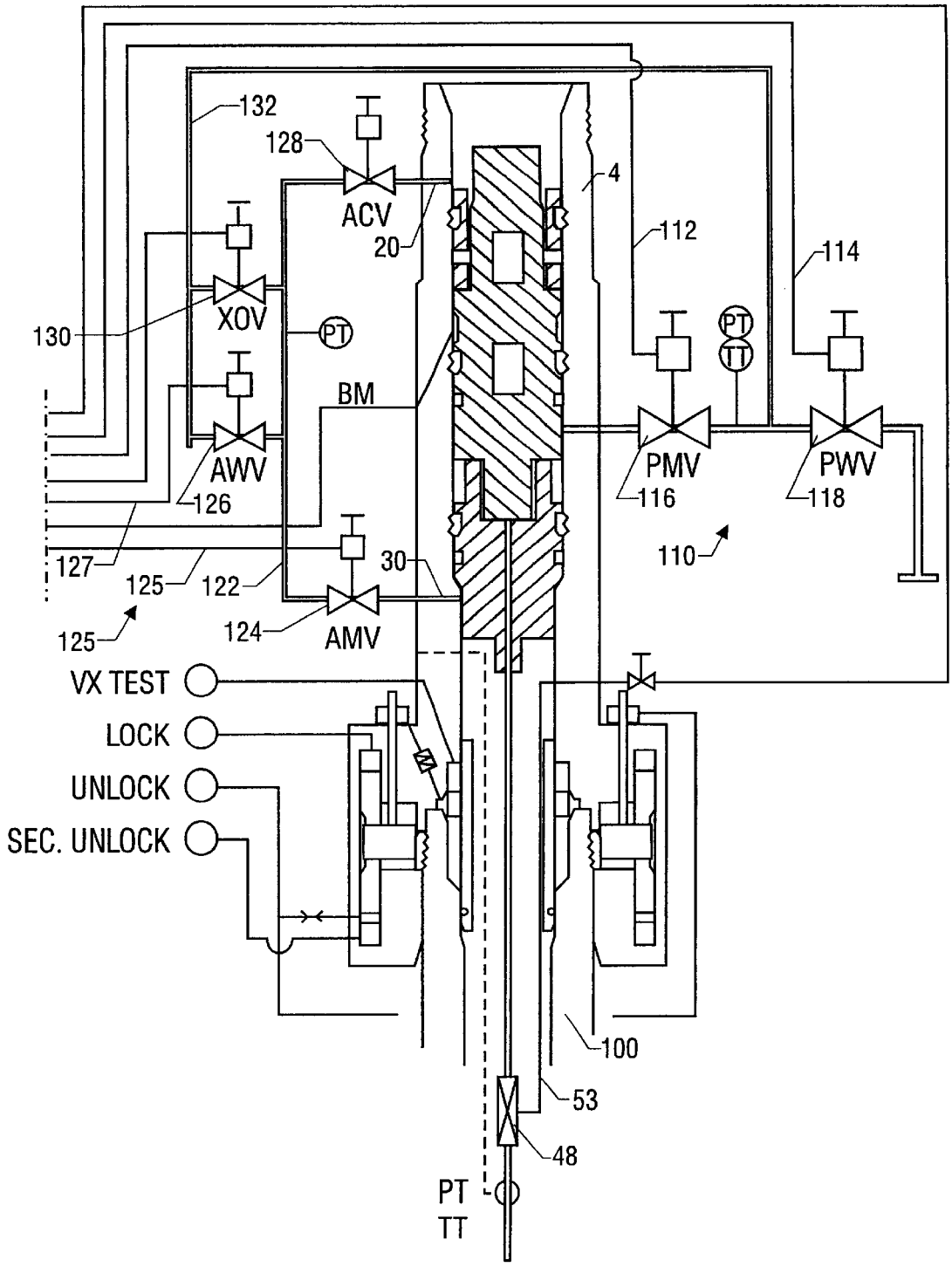
FIG. 3 is a schematic drawing of the christmas tree design of FIG. 1.

A flow port 12 constitutes a first bore through side valve tree body 4. In the embodiment of FIGS. 1C and 1D, side valve tree body 4 includes an integral valve 104. Production flow port 12 is cut radially through side valve tree body 4. In the embodiment of FIGS. 1A, 1B, and 2, the side valve tree body 4 contains a countersunk area 14 circumscribing the flow port 12 to facilitate attachment of a production valve assembly 110, as shown schematically in FIG. 3. The production valve assembly 110 (or in the embodiments of FIGS. 1C and 1D, integral production valve 104) is generally controlled hydraulically, e.g. from the surface through a control module, to regulate or stop the flow of hydrocarbons from the well. Hydraulic control lines 112 and 114 are indicated in FIG. 3. Electronically controlled valves are an option to hydraulically controlled valves. The valve assembly 110 generally contains at least one valve, however, two are common as indicated in FIG. 3 by production master valve 116 (PMV) and production wing valve 118 (PWV).

In the embodiment shown in FIGS. 1A, 1B and 2, a flanged connection fixes the valve assembly 110 to the side valve tree body 4. The countersunk area 14 may contain studs to facilitate the attachment of the first valve 116 or the valve assembly 110 by bolting. In other embodiments—such as those shown in FIGS. 1C and 1D—one of the valves or the entire valve assembly may be integral to side valve tree body 4.

At least one seal 16 is disposed between the side valve tree body 4 and the valve assembly 110 in the area of the flow port 12. Seal 16 may be located within a groove 18, and may be an o-ring or other resilient-type seal. Other embodiments may include metal-to-metal seals, or other seals known in the art. Redundant seals may also be disposed between the flow port 12 and the side valve tree body 4.

FIGS. 1A and 1B also show a tubing annulus flow port 20 disposed within the wall of side valve tree body 4. Similar ports may be included in the side valve tree body 4 shown in FIGS. 1C and 1D, although they are not shown. Tubing annulus flow port 20 enters the external wall of the tree body 4 at a suitable location to avoid the body of a connector, when such a connector is installed. In one embodiment, flow port 20 enters the throughbore 6 above the uppermost barrier, annulus mandrel 74 in the embodiment shown as FIGS. 1A, 1B and 2. This arrangement provides advantages over prior christmas trees in at least certain well killing situations; however, in other embodiments the annulus flow port 20 enters the throughbore 6 at other locations relative to the internal barriers. The annulus flow port 20 may comprise a first partial bore 21, a second partial bore 23, and a channel 25 extending therebetween. Channel 25 extends substantially longitudinally along the tree body 4.

A tubing annulus flow assembly 120, shown schematically in FIG. 3, contains external piping 122 and at least one valve. Three annulus valves are shown in FIG. 3, annulus master valve 124 (AMV), annulus wing valve 126 (AWV), and annulus circulation valve 128 (ACV). The annulus valves 124, 126, 128 in tubing annulus flow assembly 120 are generally controlled hydraulically, e.g. from the surface through a control module. Hydraulic control lines 125 and 127 are indicated in FIG. 3. Electronically controlled valves are an option to hydraulically controlled valves.

In the embodiment shown in FIGS. 1A–1D and 2, a countersunk area 22 is provided to facilitate a flanged connection between annulus flow assembly 120 and the side valve tree body 4 at the external entry of tubing annulus flow port 20, however, other connectors known in the art may be used. At least one seal 24 is disposed in a groove 26 between the side valve tree body 4 and the tubing annulus flow assembly 120 to prevent the flow of hydrocarbons to the environment at this connection. Similar to the production porting, other types and numbers of seals may be provided.

In an alternate embodiment, the tubing annulus flow assembly 120 may attach to external fluid circulation lines, such as choke and kill lines, instead of reentering the tree body 4.

FIG. 2 depicts a tubing annulus access port 30. Port 30 passes through tree body 4 from the through bore 6 below the tubing hanger 42, which when the tree 4 is completed forms an annular space or tubing annulus between the production tubing 50 and the production casing 101. As can be seen in FIG. 3, tubing annulus flow assembly 120 provides a means of fluid communication between the tubing-by-casing annulus and the throughbore 6 above the tubing hanger 42. Annulus valves 124, 126, and 128 provide one apparatus for controlling flow from the tubing annulus. In addition, crossover valve 130 and associated piping 132 provide a means for controlling flow between the tubing annulus and the production line. An electrical penetrator 120 as shown in FIGS. 1C and 1D may enable the access to the tubing annulus. Although the embodiments shown provide a well-designed apparatus for controlling flows during circulation, bullheading, injections, and other operations as may be required, those skilled in the art will appreciate that various other arrangements of valves and piping can be provided to achieve the same functions.

Additional ports or bores through the side valve tree body 4 may be included as required for hydraulic and/or electrical connections downhole. For example, in the embodiment of FIG. 1A, 1C, and 1D, a port 32 allows a hydraulic penetrator 140 (as shown in FIGS. 1C, 1D, and 2) to establish fluid communication to the hydraulic control line 53 for the downhole safety valve 48 (as shown in FIG. 3). In other embodiments, additional ports may be included for chemical injection lines, additional hydraulic and/or electric connections downhole, or various other purposes as required by a specific service.

Figure 4:
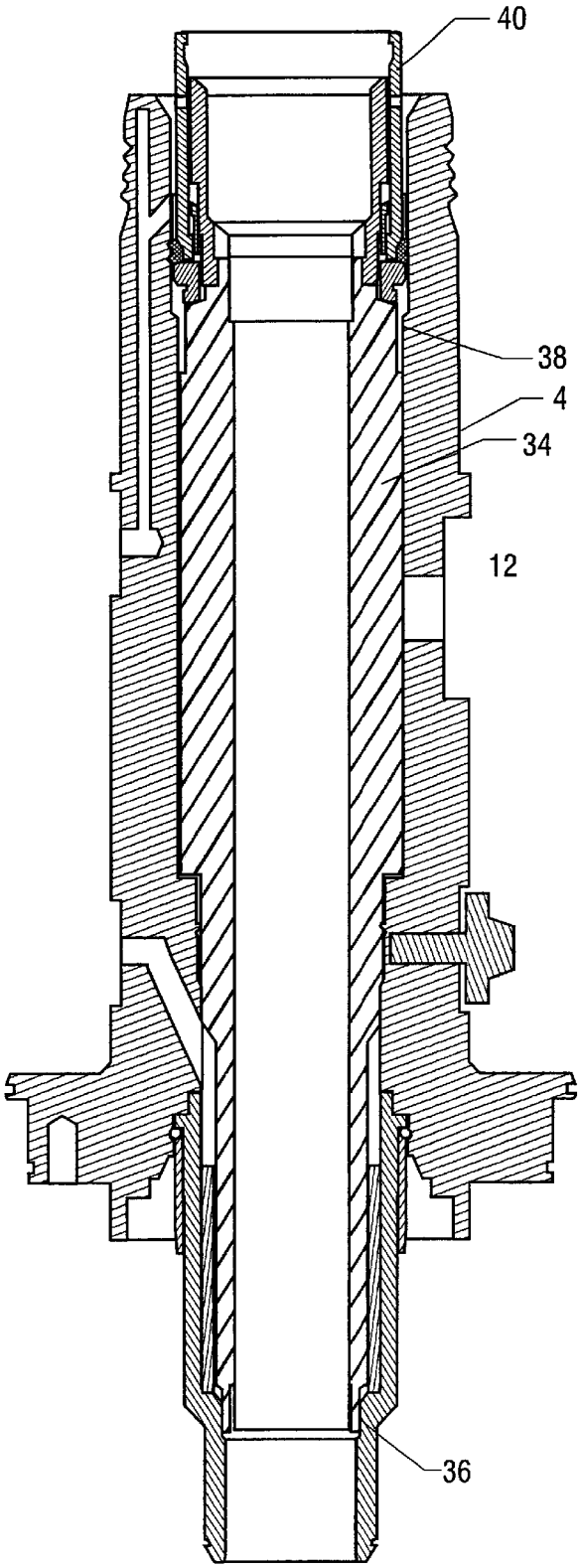
FIG. 4 diagrammatically depicts a split tree cap christmas tree with a tree bore protector installed.

Referring now to FIG. 4, the side valve tree body 4 is shown during installation with a tree bore protector 34 installed in the tree. Tree bore protector 34 contains seal 36 that seals between the bore protector and the wellhead 100. The bore protector 34 also contains a seal assembly 38 that provides a seal between the bore protector and the throughbore 6 above the production flow port 12. Tree running tool 40 is shown connected to the internal running profile 10 of tree body 4, and provides the mechanism to lock and unlock the tree bore protector 34.

Figure 5A:
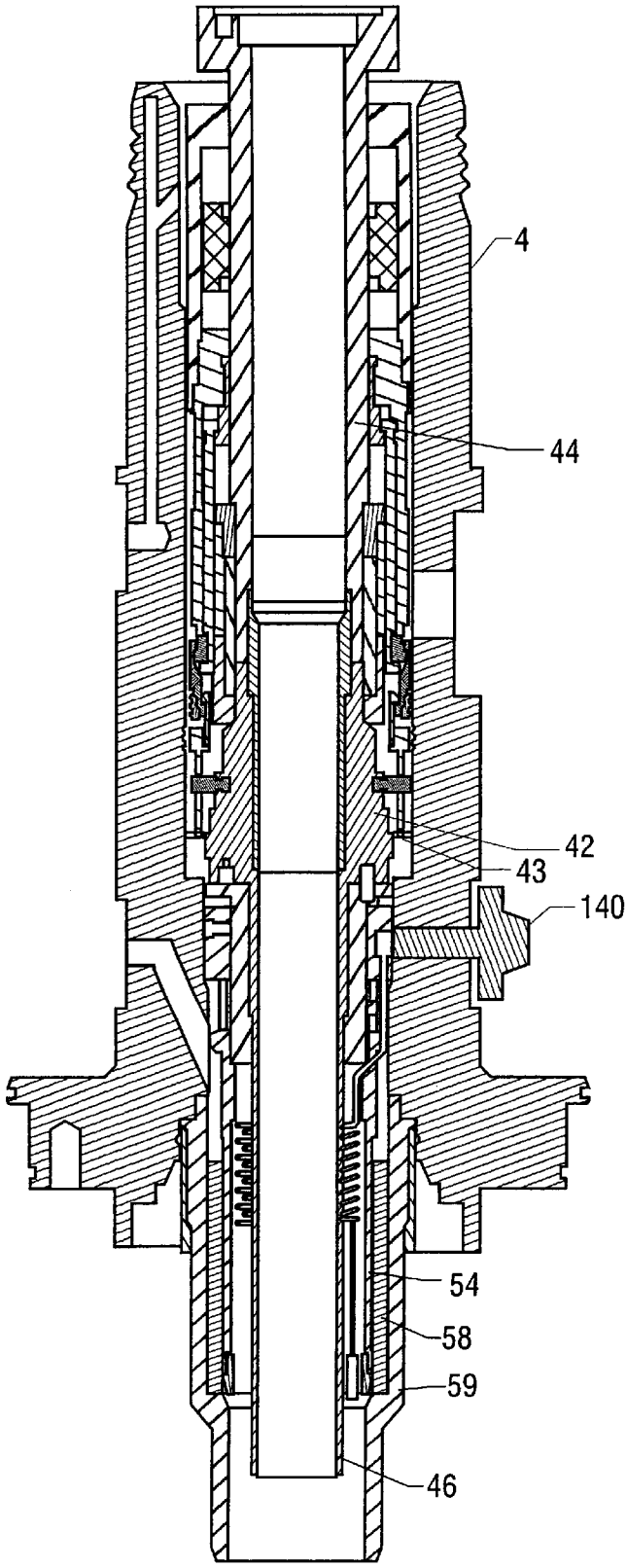
FIGS. 5A and 5B diagrammatically depict a split tree cap christmas tree during the installation of a tubing hanger.
Figure 5B:
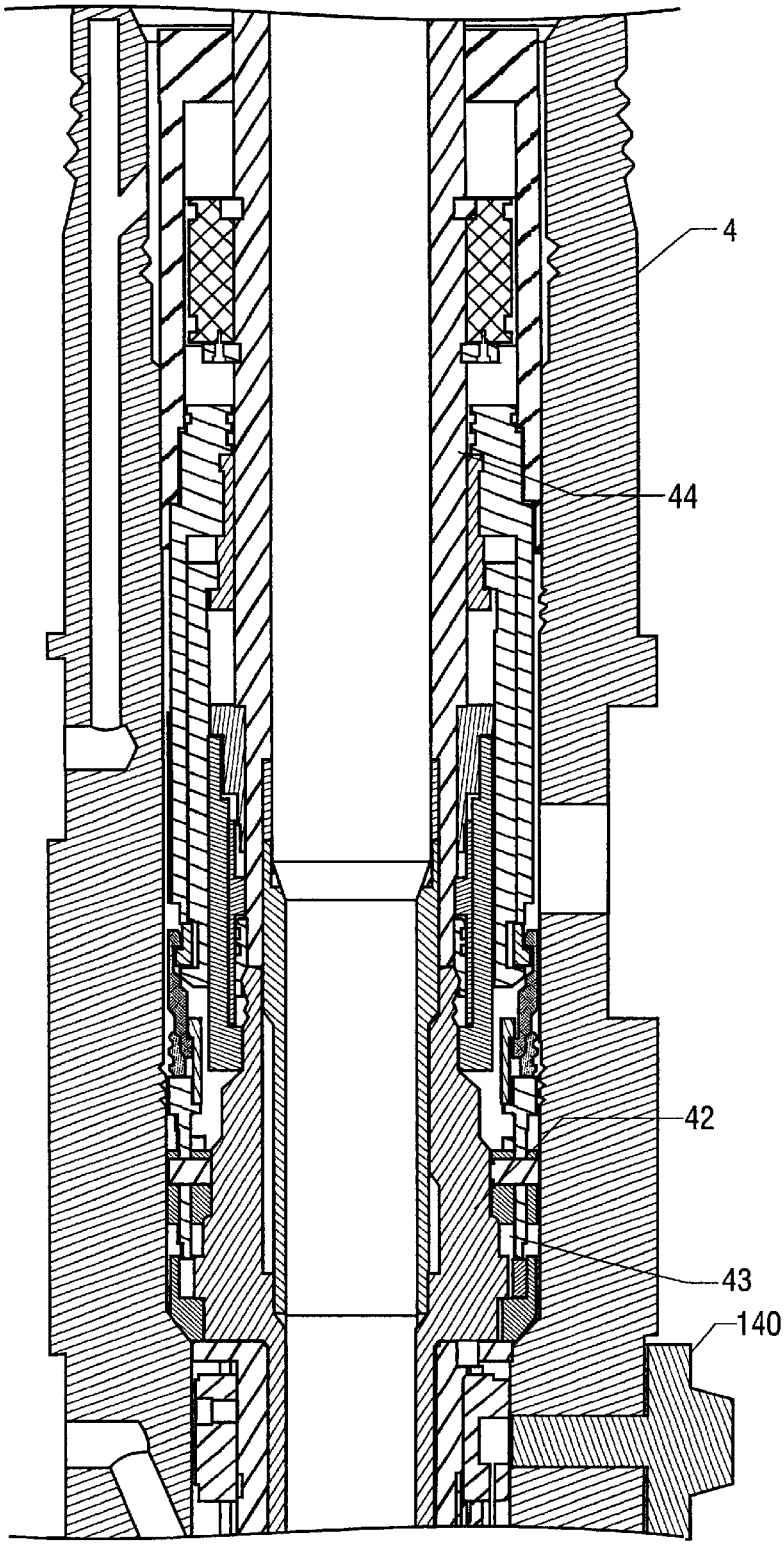
Figure 6:
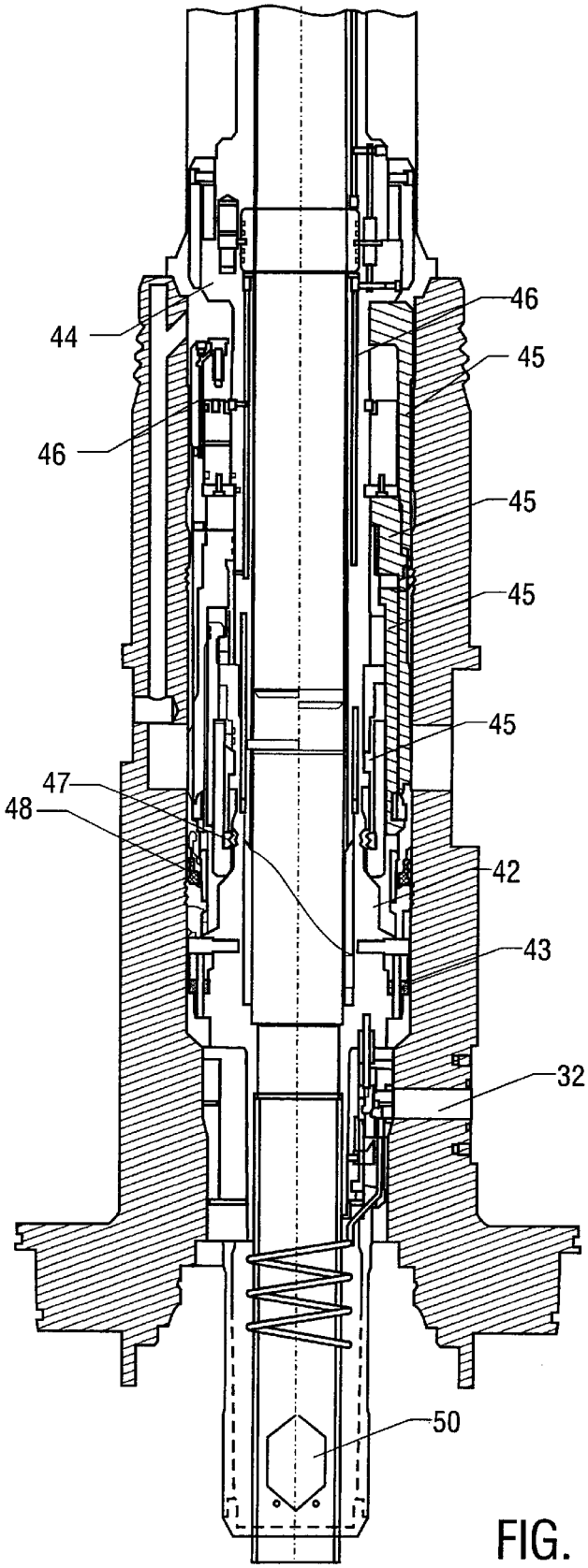
FIG. 6 depicts a split tree cap christmas tree during installation of a tubing hanger with alternate locked and unlocked positions indicated.

FIGS. 1D, 5A, 5B, and 6 show the tubing hanger 42 and associated components being run into the tree body 4 on a tubing hanger running tool 44. FIG. 6 shows the tubing hanger 42 landed in the tree body 4, in the locked position to the left of the centerline and in the unlocked position to the right of the centerline.

The tubing hanger 42 provides the means for suspending tubing into the wellbore for production of hydrocarbons. The tubing hanger defines a longitudinal throughbore of substantially similar inside diameter to that of the tubing, and may have any desired inside diameter known in the industry, including standard sizes such as 5 or 7 inches. The tubing hanger 42 is landed and suspended in side valve tree body 4. In conjunction with tubing hanger seal assembly 43, disposed between the tubing hanger 42 and the throughbore 6 of the tree body 4, the vertical load of tubing hanger 42 and its associated components are carried and transferred at shoulder 28 within the tree body 4. Tubing hanger seal assembly 43 may comprise metal-to-metal seals or resilient seals.

Production tubing 50 is disposed at the lower end of tubing hanger 42, and may be attached by a threaded connection as shown in FIGS. 1C and 6, or by other means known in the art such as bolts, pins or compression fittings. The tubing 50 extends into the well for as great or as short a length as required by the characteristics of the well. As shown schematically in FIG. 3 a downhole safety valve 52 is located significantly below the tubing hanger 42. Downhole safety valve 52 may be hydraulically controlled by hydraulic line 53, as shown in FIG. 3, or may be electrically controlled.

Referring again to FIG. 6, the tubing hanger running tool 44 is detachably connected at a first end to the completion riser or drill pipe with a standard riser joint connection. At a second end, running tool 44 is detachably connected to the tubing hanger 42. In between, a series of slidable members 45 are sealingly disposed between the body of tubing hanger running tool 44 and the tree body 4. Hydraulic passages 46 allow the flow of fluid to areas between the seals, forcing the slidable members 45 to up or down positions.

The left side of the centerline in FIG. 6 shows the tubing hanger 42 fixedly connected to running tool 44, as during the running procedure. Tubing hanger attachment ring 47 is engaged in a profile in the exterior of tubing hanger 42, and is prevented from disengaging by the slidable member 45 located adjacent. However, to the right of the centerline it is shown that the slidable members 45 can be raised allowing the tubing hanger attachment ring 47 to disengage from the profile, and thus allow retrieval of the running tool 44.

Similarly, the left side of the centerline in FIG. 6 shows the tubing hanger seal assembly 43 held in a locked position by tubing hanger seal lock down ring 48 engaged in a profile in the interior wall of tree body 4, and held in place by tubing hanger seal lock down sleeve 49. To the right of the centerline, the tubing hanger lock down sleeve 49 is raised, allowing the lock down ring 48 to disengage.

Referring again to FIGS. 1A and 1C, fixed to tubing hanger 42 is hydraulic penetrator connection assembly 60. The hydraulic penetrator connection assembly 60 provides for a sealing interface along the inner surface of the tree body 4 around the hydraulic penetrator port 32. Penetrator connection assembly 60 contains a biased cam element 62 that moves a coupler 64 into position to form a sealed contact with the penetrator 140. Accordingly, the tubing hanger 42 shown is oriented to align the hydraulic penetrator 140 connect to the downhole safety valve's hydraulic control line 53. However, the hydraulic penetrator 140 shown is not essential to the invention. Non-oriented tubing hangers are an acceptable option where another method of communication downhole is chosen. Hydraulic control line 53 may be coiled as shown to absorb movement during installation and during use.

In the embodiment shown in FIGS. 1A–1D, tubing hanger 42 is oriented by depending sleeve 54 coupled to the lower portion of the tubing hanger 42. An orientation key 56 is mounted on the depending sleeve 54. Referring to FIG. 5A, during installation of the tubing hanger 42 the orientation key 56 (not shown) on depending sleeve 54 contacts a cam surface on an orientation sleeve 58. The orientation sleeve 58 is mounted within an isolation sleeve 59. Isolation sleeve 59 provides seals to the production casing 101 in wellhead 100 and to the tree body 4, and provides a recess to carry the orientation sleeve 58. Other means of orienting the tubing hanger, such as using a pin and groove system either in a blowout preventer or in the tree, are easily adaptable to the system as shown.

Figure 7A:
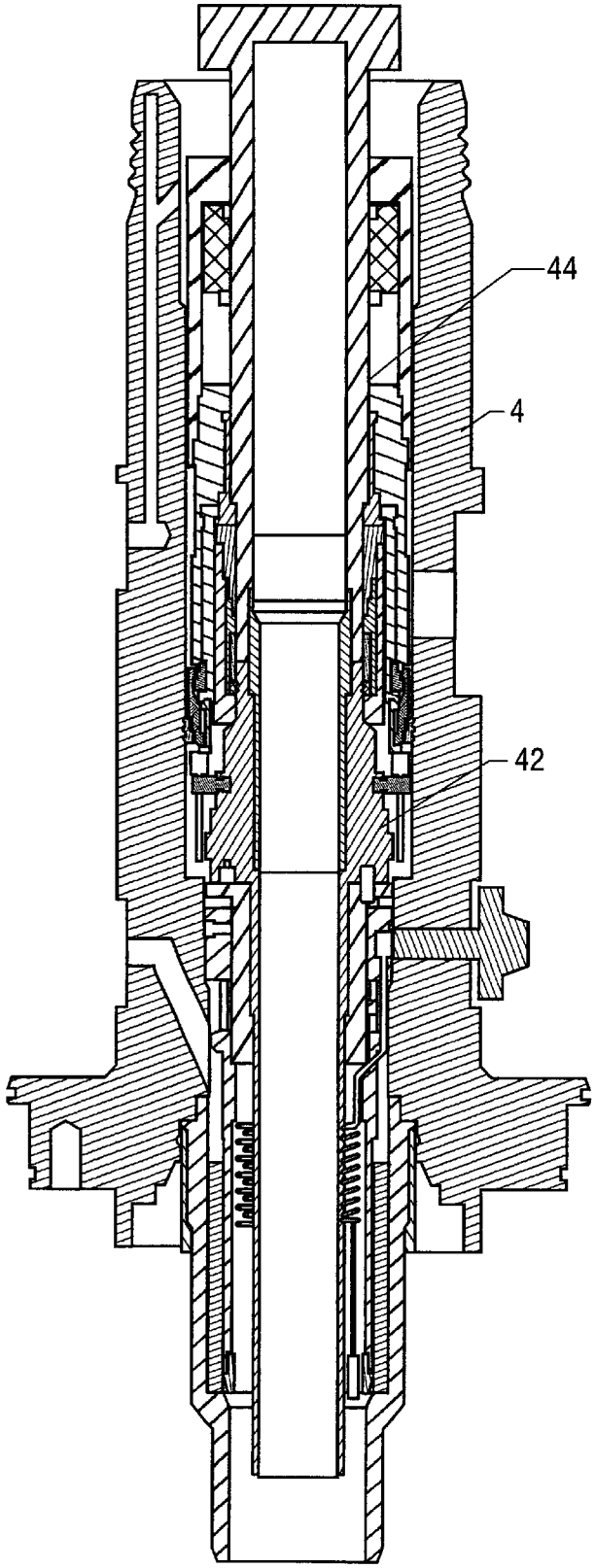
FIGS. 7A and 7B diagrammatically depict a split tree cap christmas tree with a tubing hanger installed, landed and locked.
Figure 7B:
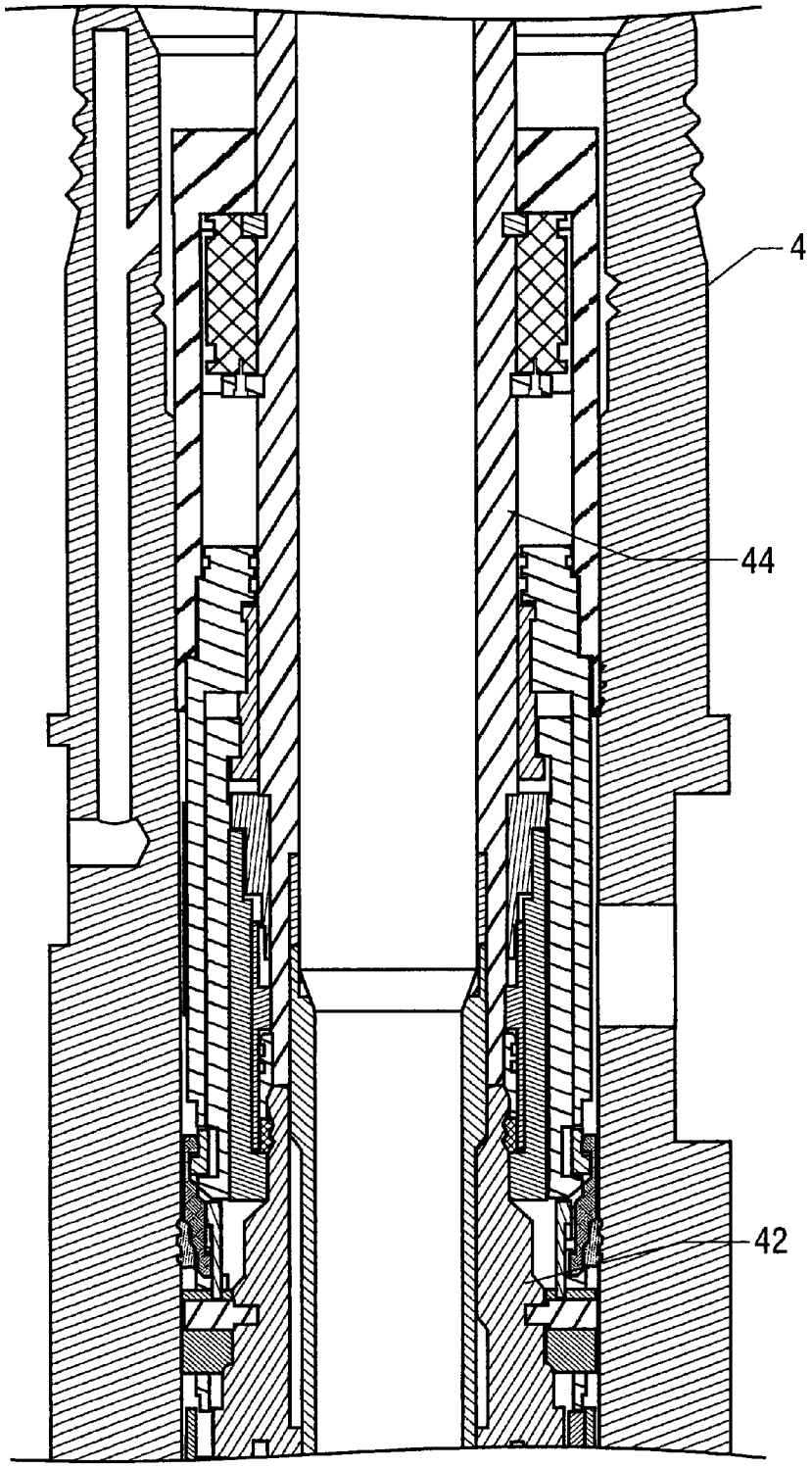

FIGS. 7A and 7B, like the left side of FIG. 6, show the tubing hanger 42 landed and locked within the side valve tree body 4. In FIGS. 7A and 7B the tubing hanger running tool 44 is shown still attached to the tubing hanger 42.

Figure 8A:
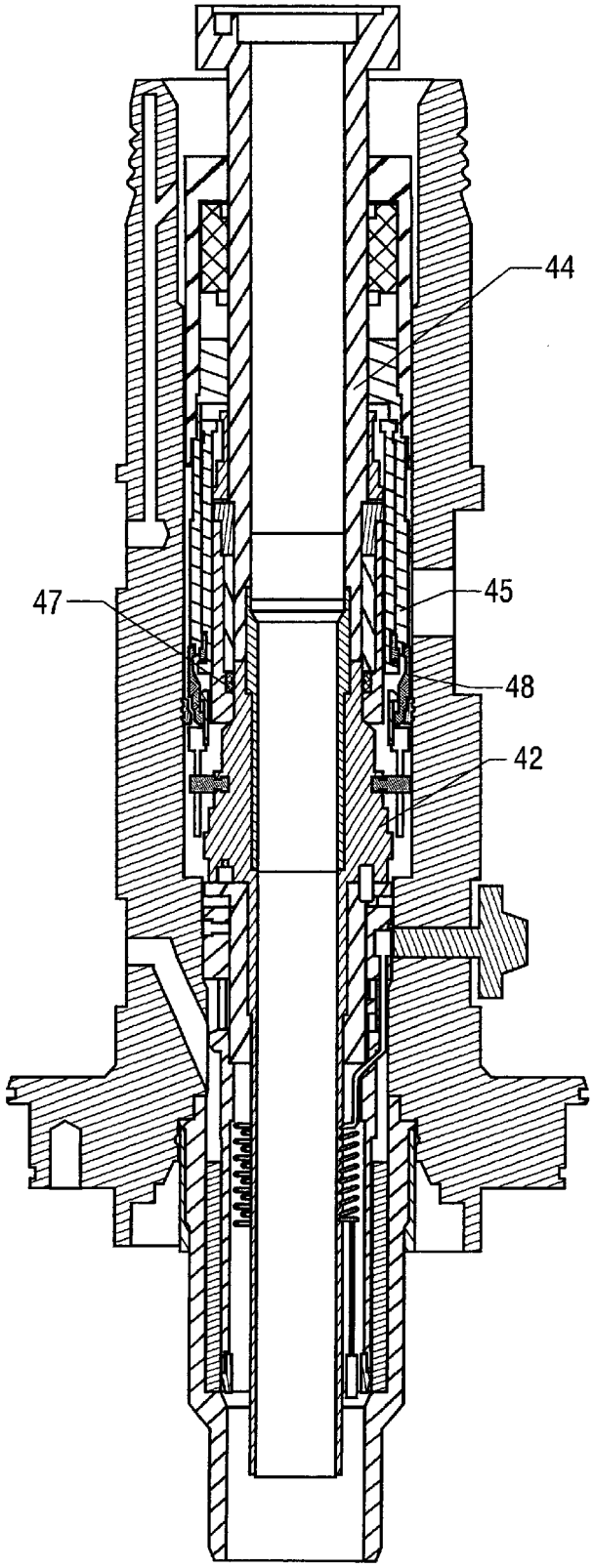
FIGS. 8A and 8B diagrammatically depict a split tree cap christmas tree with a tubing hanger installed, landed and locked during retrieval of the tubing hanger running tool.
Figure 8B:
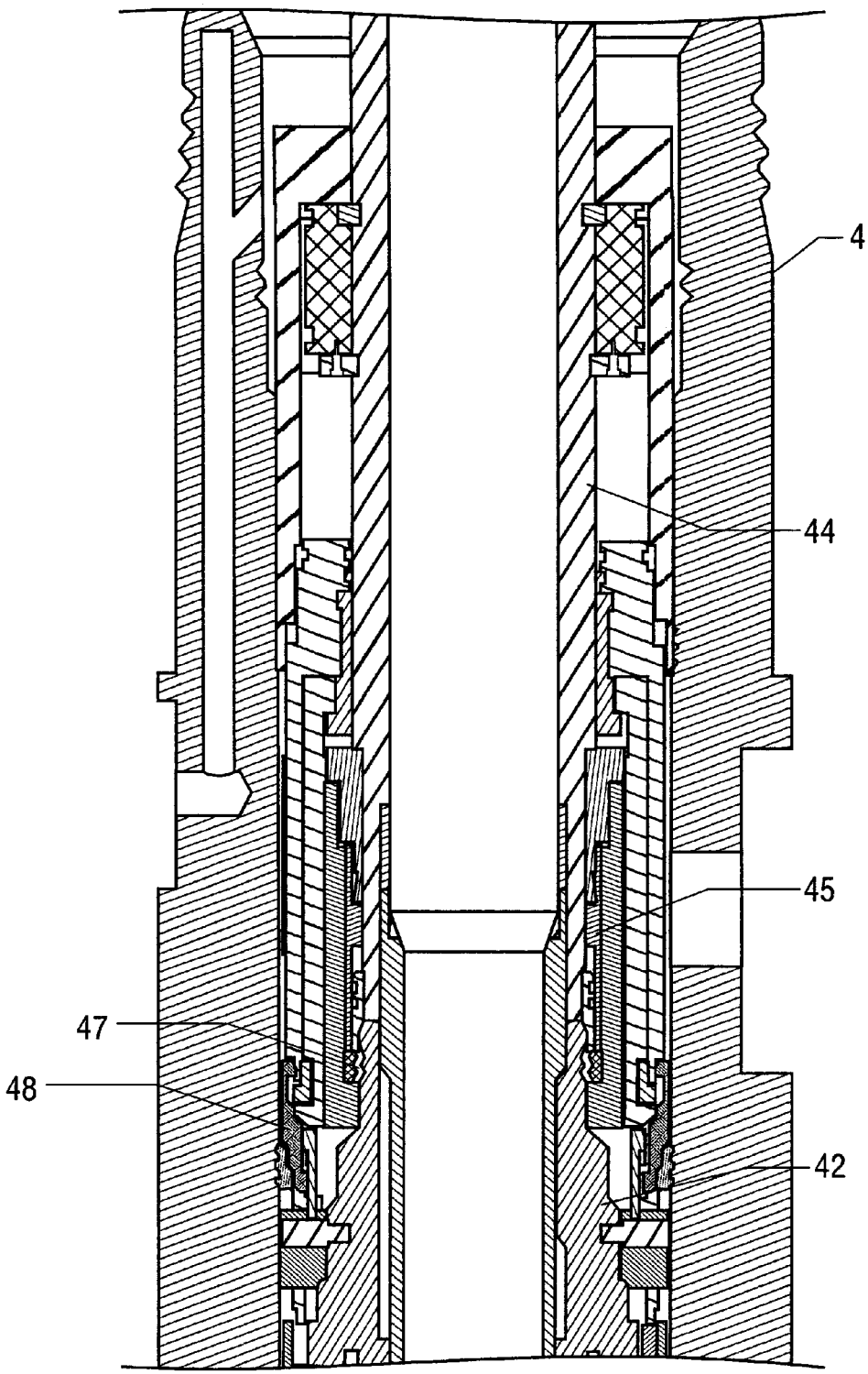

FIGS. 8A and 8B show the tubing hanger running tool 44 released from the tubing hanger 42. A latch ring in running tool 44 is released from the tubing hanger seal lock down ring 48 by hydraulic pressure which moves the slidable members 45 generally outward and upward. Similarly, tubing hanger attachment ring 47 disengages from its profile on the upper mandrel of tubing hanger 42. Accordingly, the tubing hanger running tool 44 can be removed, leaving the tubing hanger 42 installed in the tree body 4 as shown in FIG. 9.

Figure 9:
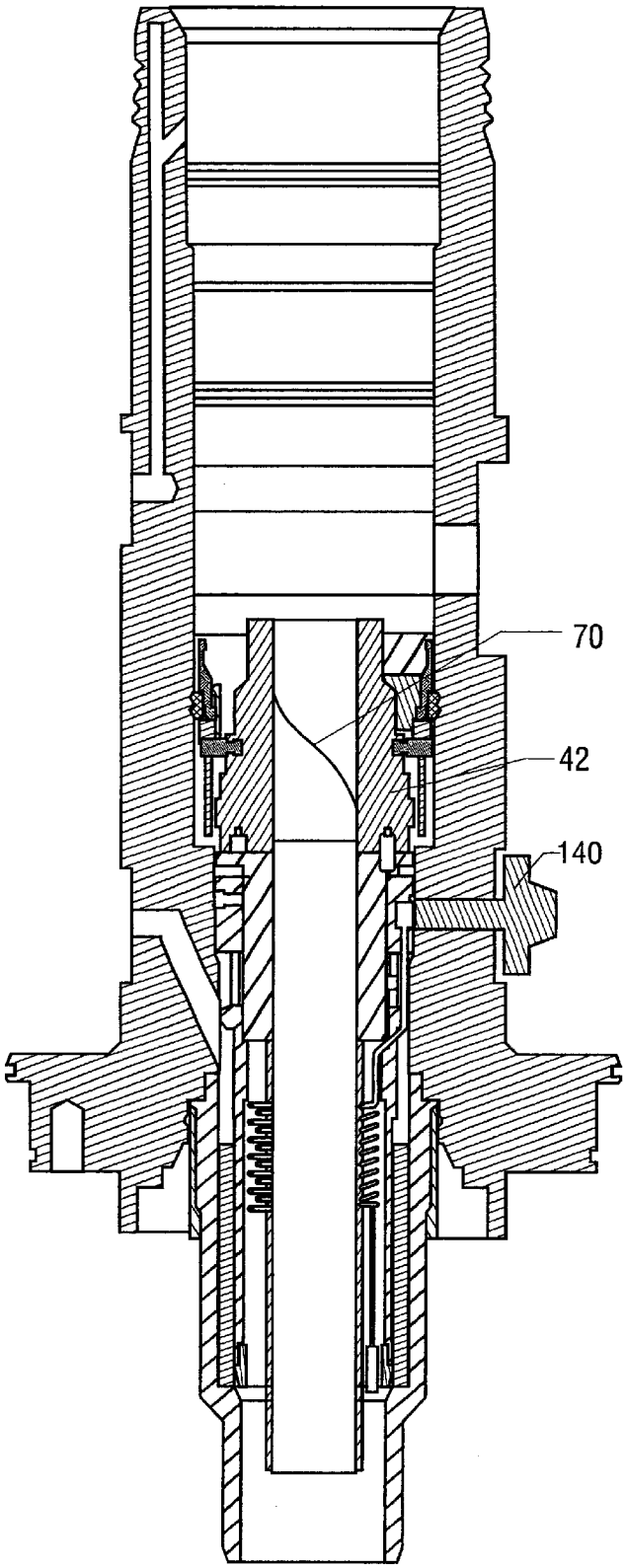
FIG. 9 diagrammatically depicts a split tree cap christmas tree with a tubing hanger installed and without running tools.

Referring to FIGS. 1 and 9, the tubing hanger 42 contains a cam profile 70. As shown in FIG. 1, the cam profile 70 may be contained on a cylindrical insert 72 journalled within the tubing hanger 42, or alternatively may be machined into the internal throughbore of tubing hanger 42.

As shown in FIG. 1A, installed above the tubing hanger is an internal tree cap flow divertor, for example an actuation mandrel 74 and plug 94 . Actuation mandrel 74 is substantially coaxial with side valve tree body 4 and exhibits a longitudinal throughbore of substantially similar diameter to that of the production tubing. Actuation mandrel 74 lands above the tubing hanger 42, and its longitudinal throughbore is coextensive with the longitudinal throughbore of the tubing hanger 42. In addition, the actuation mandrel 74 contains a radially drilled bore 76 that allows produced hydrocarbons to be diverted from the longitudinal throughbore.

As seen in FIG. 1, bore 76 of actuation mandrel 74 is relatively aligned vertically and radially with flow port 12 through side valve tree body 4. In the embodiment shown this alignment is achieved through a cam system.

Figure 10A:
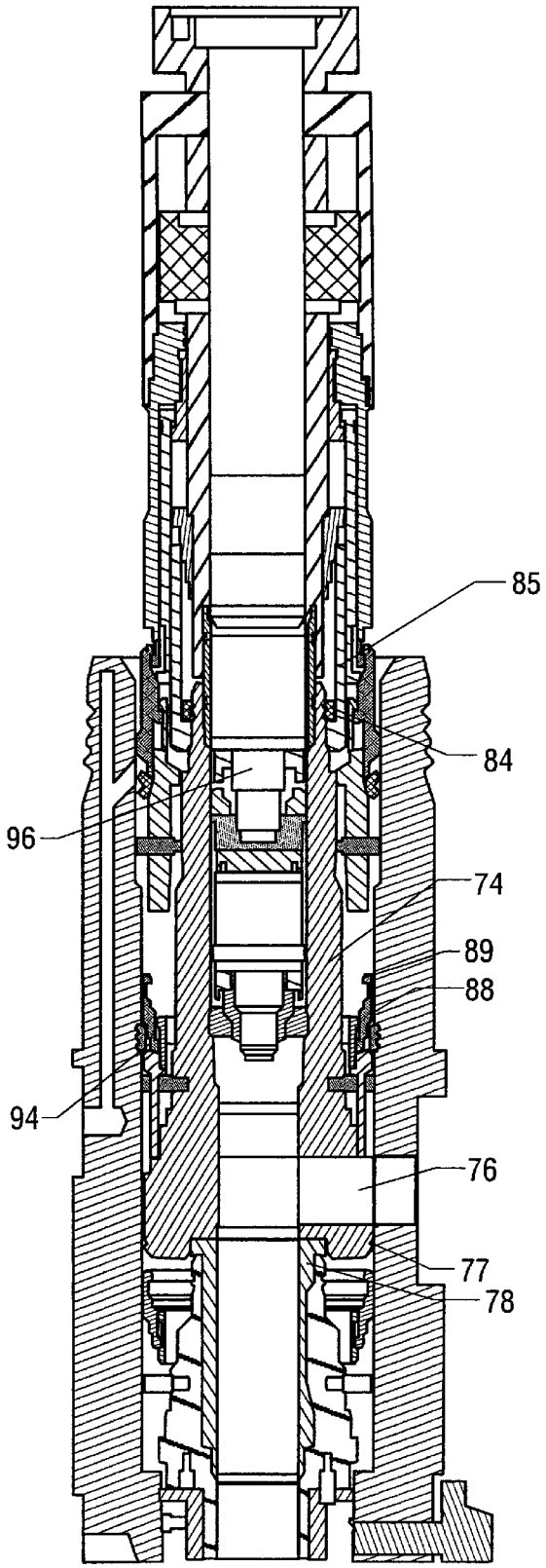
FIGS. 10A and 10B diagrammatically depict a split tree cap christmas tree during the installation of a split tree cap and plugs.
Figure 10B:
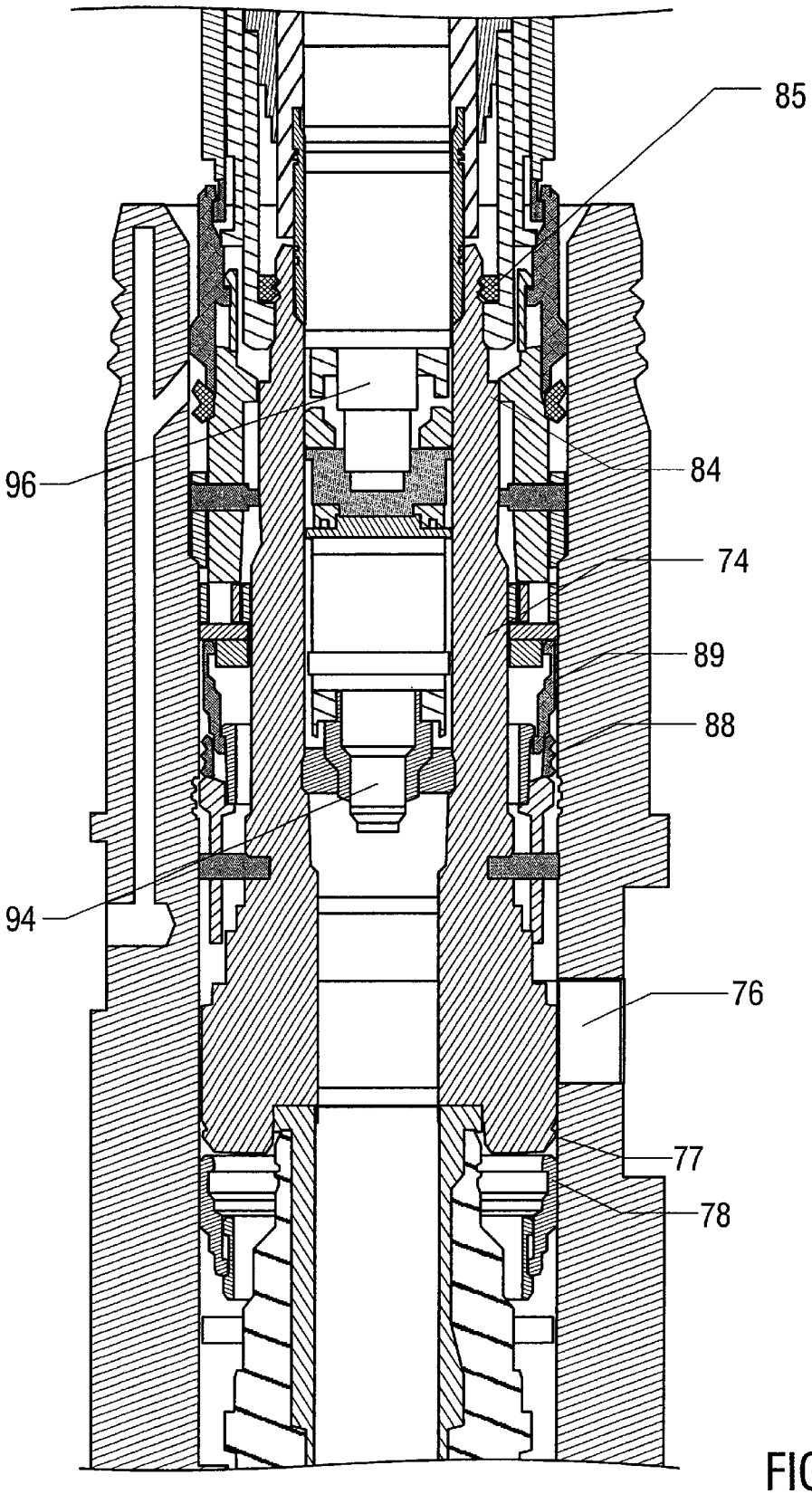

Disposed at the lower end of actuation mandrel 74 is a depending cylinder 78 which extends into the tubing hanger 42. Depending cylinder 78, also called a sleeve, is separate from the actuation mandrel 74, and may be bolted as shown, or attached by other means commonly known in the art such as threaded connections, split ring connections, etc. Seals 79 and 80 restrict or prevent the passage of fluid between the interfaces of cylinder 78 and the tubing hanger 42, and between the cylinder 78 and the actuation mandrel 74 respectively. When the actuation mandrel 74 is installed (as shown in FIGS. 1A, 10A, and 10B) a key 82 fixed to the depending cylinder 78 interacts with the cam surface 70, causing the actuation mandrel 74 to rotate for orientation. The degree of precision in the rotation and orientation is a matter of design choice, and can be as rough or precise as operating conditions require.

In addition, embodiments are envisioned wherein the actuation mandrel 74 is non-oriented. In such a case, produced fluids would be routed through an annular recess similar to that shown by reference numeral 13 but sized to permit annular flow without overly restricting flow velocity. Gallery seals (similar to seal 77 below the bore 76) would be installed above and below the bore 76 forcing flow to remain in the annular groove until exiting at the bore 76. Additional bores similar to 76 could be added to reduce the restriction in flow caused by radial misalignment.

The outer wall of actuation mandrel 74 contains a series of reduced diameter steps or shoulders 83 that allow for the proper positioning, installation and landing of pack-off seals. The upper portion of actuation mandrel 74 contains an external profile 84 that allows the tree cap to be latched to a running tool using tree cap attachment ring 85, as shown in FIGS. 10A and 10B. Running tool profile 84 may match the profile at the top of the tubing hanger 42, as shown more clearly in FIG. 1, to allow the use of the tubing hanger running tool 44 for installation and removal of the actuation mandrel 74.

Two sets of pack-off seals 86, 90 are installed externally around the circumference of the actuation mandrel 74. In one embodiment, as shown in FIG. 1, pack-off seal 86 comprises seal element 87, shown as resilient seals, to restrict and prevent the passage of produced fluids above the production bores 76 and 12 in throughbore 6. Pack-off seal 86 is shown coupled to actuation mandrel 74 such that the two may be run into the tree as one unit. Referring to FIGS. 10A and 10B, before the lower pack-off seal assembly 86 is landed, lower seal lock down ring 88 is not engaged in the mating profile in the throughbore of tree body 4. However, after the actuation mandrel 74 is landed and locked, as shown in FIGS. 1A–1C, 11A, and 11B, the seal lock down ring 88 is engaged in the profile and prevented from moving out of the profile by lower seal lock down sleeve 89. Lower seal lock down sleeve 89 also contains a latching profile at its upper edge to couple to the running tool for removal of the lower seal assembly 86 as may be required.

Referring again to FIGS. 1A–1C, upper pack-off seal assembly 90 is shown landed and locked above the lower pack-off seal 86. Seal element 91 is shown having metal-to-metal sealing. However, it should be noted that the sealing elements 86 and 91 of pack-off seals 86 and 90 can be resilient, metal-to-metal, or any combination of both. In the embodiments of FIGS. 1A–1C, upper pack-off seal 90 is not coupled to the actuation mandrel 74, but it is run into the tree separate from the actuation mandrel 74 and lower pack-off seal 86. Alternatively, as shown in FIGS. 10A and 10B, pack-off seal 90 may be coupled to actuation mandrel 74 such that the two seal assemblies 86 and 90 and the actuation mandrel 74 may be run into the tree in one trip as a combined unit. Further, both seal assemblies 86 and 90 and the actuation mandrel 74 could be run individually in separate trips.

Figure 11A:
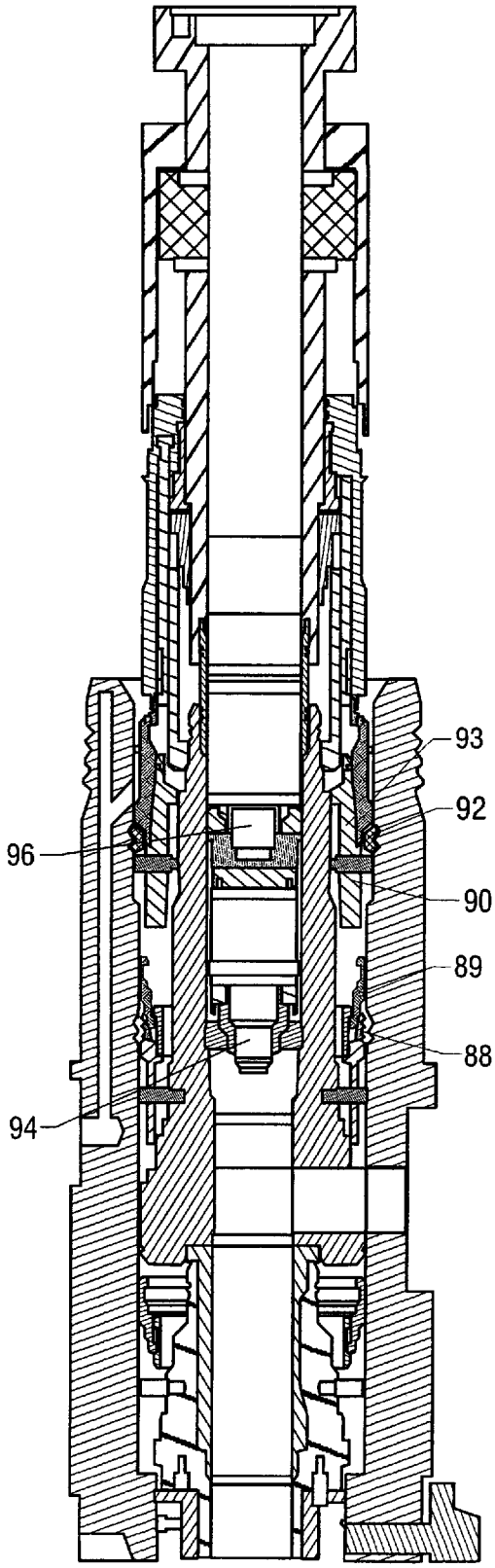
FIGS. 11A and 11B diagrammatically depict a split tree cap christmas tree with a split tree cap installed, landed and locked.
Figure 11B:
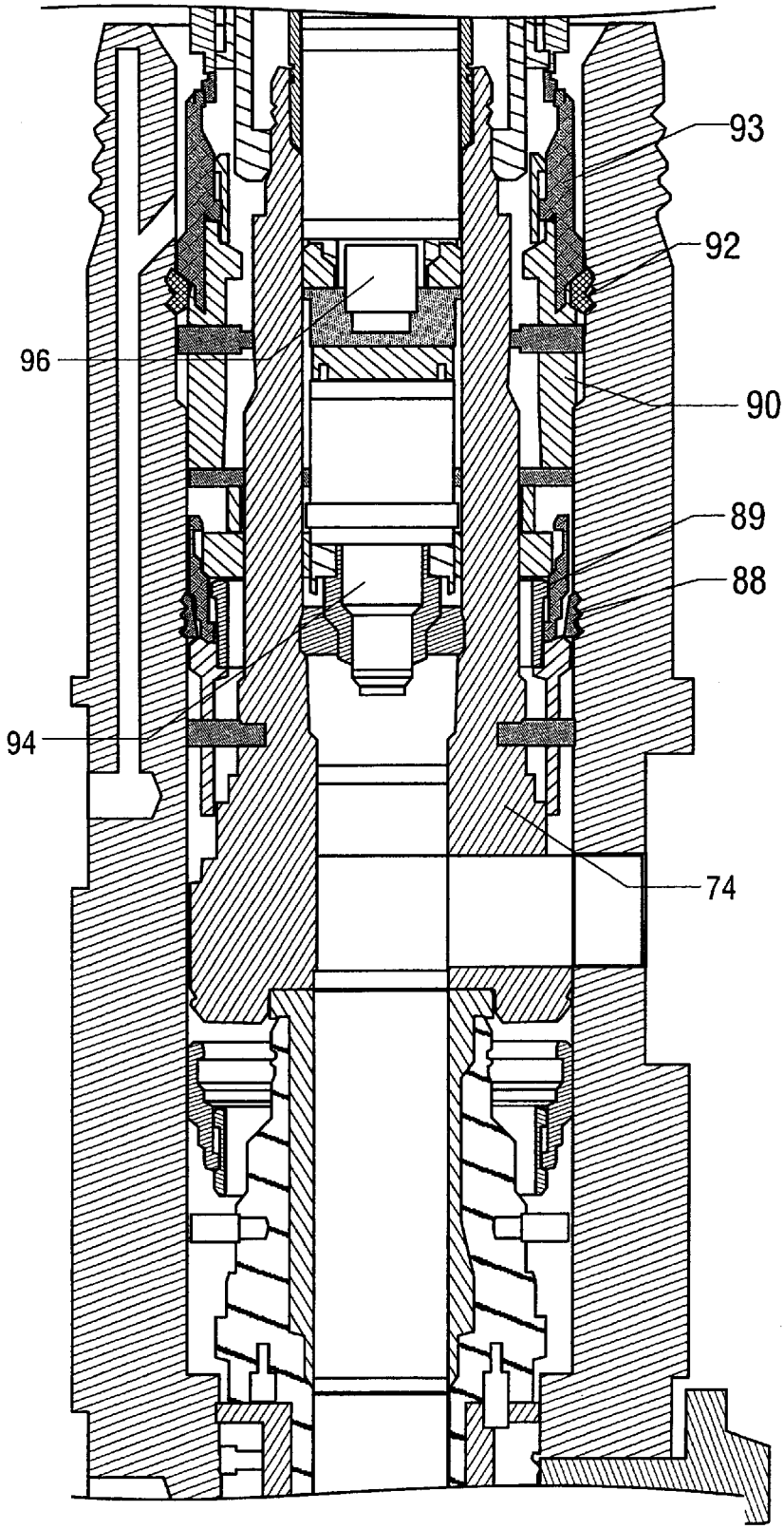

Referring to FIGS. 11A and 11B, before the upper pack-off seal assembly 90 is landed, upper seal lock down ring 92 is not engaged in the mating profile in the throughbore of tree body 4. However, after the actuation mandrel 74 is landed and locked, as shown in FIGS. 11A and 11B, upper seal assembly 90 is in place and the upper seal lock down ring 92 is engaged in profile 10. The lock down ring 92 is prevented from moving out of the profile 10 by upper seal lock down sleeve 93. Upper lock down sleeve 93 also contains a latching profile at its upper edge to couple to the running tool for removal of the upper seal assembly 90. In preferred embodiments, the actuation mandrel 74 and the seal assemblies 86 and 90 are coupled to run in one trip.

However, the coupling mechanism allows the independent removal of one or both seal assemblies, such as by coupling with shear pins.

The throughbore of actuation mandrel 74 contains two plugs 94 and 96. When installed, the plugs 94 and 96 serve as redundant barriers to prevent the flow of hydrocarbons up the longitudinal throughbore, and to divert the flow into the bore 76. Each plug is locked and landed in an internal profile 95 and 97. The plugs 94 and 96 may be wireline retrievable plugs, coiled tubing plugs, valves, or other closures, and may be mechanically or hydraulically actuated. At least the lower plug may contain hard facing to resist damage from the production stream, and be located so as to minimize turbulence in the production flow stream. As shown in FIG. 10A and 10B the plugs 94 and 96 may be run with the actuation mandrel 74, however, each plug is independently retrievable. With both of plugs 94 and 96 located in the tree cap 74, an operator may advantageously run or retrieve a tubing hanger without setting a plug in the tubing hanger, thereby eliminating a plug-setting trip.

Figure 12A:
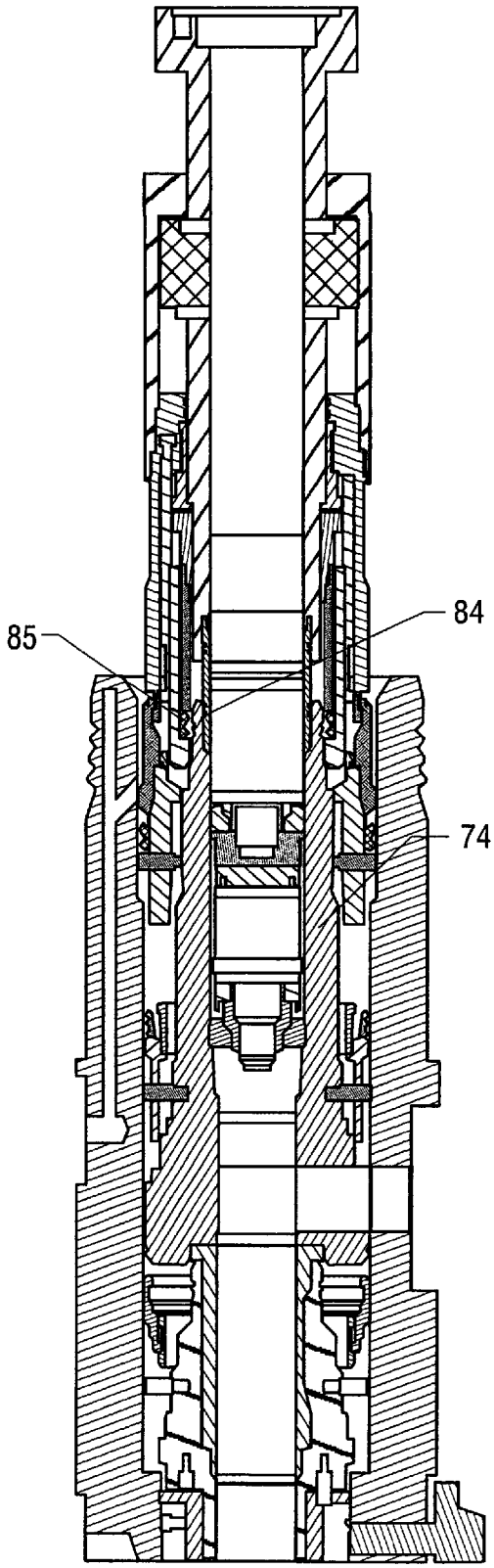
FIGS. 12A and 12B diagrammatically depict a split tree cap christmas tree with a split tree cap installed, landed and locked during retrieval of a tree cap running tool.
Figure 12B:
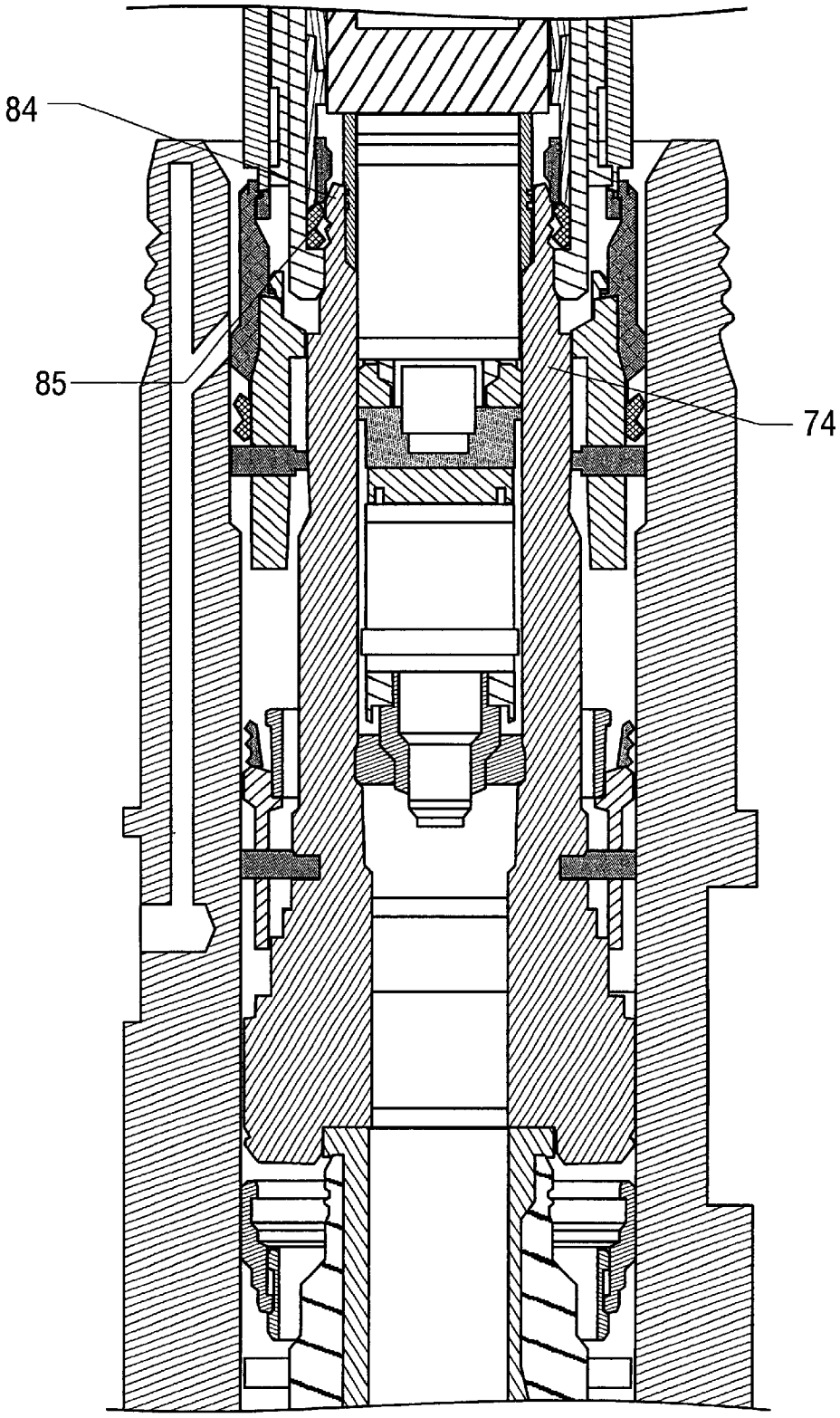
Figure 13:
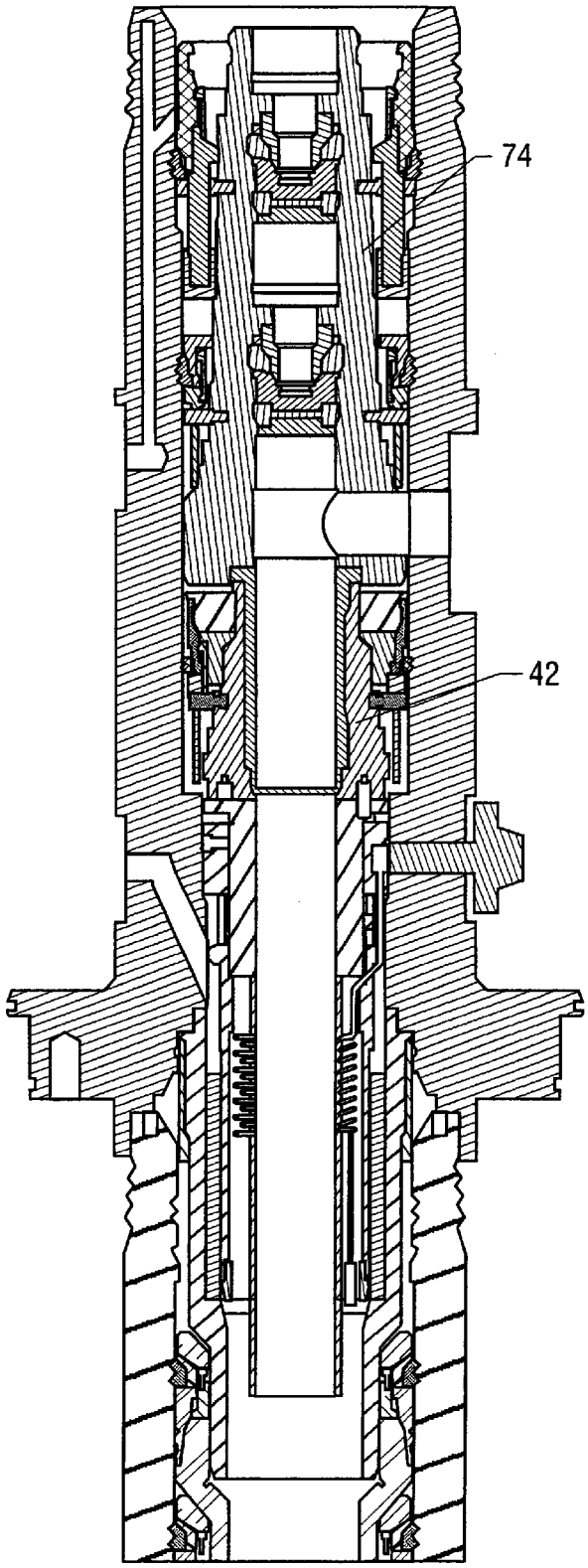
FIG. 13 diagrammatically depicts an embodiment of the split tree cap christmas tree with the tubing hanger and split tree cap installed.

FIGS. 12A and 12B show the tree cap attachment ring 85 released from the profile 84 in actuation mandrel 74 to allow the retrieval of the running tool.

The embodiments shown in FIGS. 1A, 1C, 2 and 13 show the christmas tree system 2 in the production mode, with the tubing hanger 42 and the actuation mandrel 74 installed.

While the present invention has been particularly shown and described with reference to a particular illustrative embodiment thereof, it will be understood by those skilled in the art that various changes in form and details may be made without departing from the spirit and scope of the invention. The above-described embodiment is intended to be merely illustrative, and should not be considered as limiting the scope of the present invention.

What is claimed is:

1. A christmas tree to control the production from a subsea oil or gas well comprising:

a) a tree body having a first production flow port;

b) a tubing hanger landed within the tree body;

c) an actuation mandrel landed within the tree body above the tubing hanger, the actuation mandrel having a second production flow port in fluid communication with said first flow port; and d) a flow diverter disposed within the actuation mandrel to divert flow through the production flow ports.

2. The christmas tree of claim 1 further comprising a backup flow diverter disposed within the actuation mandrel.

3. The christmas tree of claim 2 wherein the flow diverter and backup flow diverter comprise plugs.

4. The christmas tree of claim 1 wherein the plugs are set by wireline.

5. The christmas tree of claim 1 wherein the first flow port is a production flow port.

6. The christmas tree of claim 5 wherein the first flow port is a radial bore through the tree body.

7. The christmas tree of claim 1 wherein the tree body comprises a second flow port.

8. The christmas tree of claim 7 wherein the second flow port comprises an annulus flow port.

9. The christmas tree of claim 8 wherein annulus flow port comprises a first partial bore, a second partial bore, and a channel extending therebetween.

10. The christmas tree of claim 9 wherein the channel extends substantially longitudinally along the tree body.

11. The christmas tree of claim 9 wherein the first and second partial bores are arranged opposite one another.

12. The christmas tree of claim 7 further comprising a third flow port.

13. The christmas tree of claim 12 wherein the third flow port provides fluid communication to a downhole safety valve.

14. The christmas tree of claim 13 wherein the third flow port is receptive of a hydraulic penetrator to establish fluid communication to the downhole safety valve.

15. The christmas tree of claim 12 further comprising a fourth flow port.

16. The christmas tree of claim 15 wherein the fourth flow port provides for chemical injection into the well.

17. The christmas tree of claim 1 wherein the tree body further comprises an integral production valve.

18. The christmas tree of claim 1 wherein the tree body further comprises a first countersunk area receptive of a production valve assembly.

19. The christmas tree of claim 18 wherein the tree body further comprises a second countersunk area receptive of an annulus flow assembly.

20. The christmas tree of claim 19 wherein the annulus flow assembly attaches to external fluid circulation lines.

21. The christmas tree of claim 20 wherein the external fluid circulation lines comprise choke or kill lines.

22. A method of controlling production from a subsea oil or gas well comprising steps of:

a) installing a side valve tree onto a wellhead;

b) running a tubing hanger into the well;

c) landing the tubing hanger in the side valve tree;

d) installing an actuation mandrel in the side valve tree above the tubing hanger, said actuation manderal having a plurality of plugs set therein;

wherein there are no plugs set in the tubing hanger.

23. The method of claim 22 further wherein the step of installing a side valve tree onto the wellhead further comprises providing tree bore protector installed in the side valve tree.

24. The method of claim 22 wherein the tubing hanger comprises a production tubing suspended therefrom.

25. The method of claim 22 wherein the tubing hanger comprises an orientation key mating with an orientation sleeve.

26. The method of claim 25 further comprising the step of orienting the tubing hanger within the tree body.

27. The method of claim 22 further comprising the step of locking the tubing hanger within the tree body.

28. The method of claim 22 wherein the step of installing an actuation mandrel with a plurality of plugs set therein further comprises orienting the actuation mandrel.

29. The method of claim 22 wherein the actuation mandrel comprises a plurality of reduced-diameter shoulders and pack-off seals.

30. The method of claim 29 wherein the step of installing an actuation mandrel with a plurality of plugs set therein further comprises landing the shoulders and seal within the tree body.

31. A method of servicing a subsea oil or gas well with a side-valve christmas tree comprising steps of:

a) running an actuation mandrel retrieval tool into the christmas tree;

b) engaging the actuation mandrel retrieval tool with an actuation mandrel;

c) retrieving the actuation mandrel; and d) retrieving a tubing hanger located within the christmas tree;

wherein there is no step of retrieving any plugs that may be located within the tubing hanger.

* * * * *